United States Patent [19]

Hall

[11] 4,188,151

[45] Feb. 12, 1980

[54] MANHOLE EXTENSION ASSEMBLY

[75] Inventor: John R. Hall, Atlanta, Ga.

[73] Assignees: Margaret T. Hall, Atlanta, Ga.; James B. Turner, Jr., Raleigh, N.C.

[21] Appl. No.: 891,715

[22] Filed: Mar. 30, 1978

Related U.S. Application Data

[63] Continuation-in-part of Ser. No. 844,649, Oct. 25, 1977.

[51] Int. Cl.[2] ..... E02D 29/14

[52] U.S. Cl. ..... 404/26; 52/21; 210/164; 404/25

[58] Field of Search ..... 404/26, 25; 52/19, 21; 210/163, 164

[56] References Cited

U.S. PATENT DOCUMENTS

| | | | |
|---|---|---|---|
| 1,459,588 | 6/1923 | Hoffman | 404/25 X |
| 1,940,924 | 12/1933 | Taylor | 404/25 X |
| 2,314,682 | 3/1943 | Becket | 404/25 |
| 2,431,082 | 11/1947 | Sayles | 404/26 |
| 2,593,918 | 4/1952 | Redman | 404/26 |
| 3,217,619 | 11/1965 | Driver | 404/25 |
| 3,240,133 | 3/1966 | Ross | 404/26 |
| 3,308,727 | 3/1967 | Hurt | 404/25 X |
| 3,362,425 | 1/1968 | Morris | 404/26 X |
| 3,408,778 | 11/1968 | Mason | 404/26 X |

*Primary Examiner*—Nile C. Byers, Jr.

*Attorney, Agent, or Firm*—Newton, Hopkins & Ormsby

[57] ABSTRACT

Plastic extender rings for manholes are produced and are seated on the top ring of a manhole by the use of caulking or other adhesive material. The manhole cover, which is elevated by the plastic ring or rings from the old pavement level to a new pavement level, renders the manhole cover less noisy to traffic and seated more evenly. Recessed or notched portions of the rings receive the asphalt to arrest rotational and upward movement of the rings. Composite adapter rings are provided to adapt an off size manhole top rings, to a standard size manhole cover. Plastics are employed which will not melt at the application temperature of asphalt but will soften somewhat to conform better to the contour of the manhole cover and/or underlying manhole top ring.

14 Claims, 12 Drawing Figures

MANHOLE EXTENSION ASSEMBLY

CROSS-REFERENCE TO RELATED APPLICATION

This is a continuation in part of my copending application Ser. No. 844,649 filed Oct. 25, 1977.

BACKGROUND OF THE INVENTION

1. Field of the Invention

This invention relates to a manhole extension assembly and is more particularly concerned with extension rings for raising the effective height of a top ring of a manhole.

2. Description of the Prior Art

The prior art for some time has recognized the need for manhold extender means to raise the level of the cast iron manhole cover to a new pavement level when streets are resurfaced. Commonly, a metal extender ring of the necessary thickness is welded to the manhole top ring to raise the level of the manhole cover, as required. Other prior art proposals include adjustable manhole extenders, such as screw-threaded extender rings. All of these porposals will accomplish the desired result, but generally speaking they are costly to manufacture or require a good deal of labor for installation, particularly in the case of welded rings. The disadvantages of these prior art extender rings is that welded joints break under heavy traffic and mechanical joints loosen under vibration. Some examples of the patented prior art are shown in the following U.S. Pat. Nos: 1,639,495, 3,408,778, 1,908,909, 3,490,177, 2,903,875, 3,533,199, 3,385,011, 3,629,981, 3,968,600.

Even with the improvements of the above discussed patents, the common way today to raise the level of a manhole cover is through use of shims beneath the ground ring. This, of course, requires that the dirt around the ring be excavated to permit installation of the shims and return of the dirt after such installation.

SUMMARY OF THE INVENTION

Briefly described, the present invention includes as the manhole extension assembly an extender ring disposed on the upper end portion of the manhole top ring. This ring is also known as a "manhole frame" or "base ring". The extender ring in one form of the present invention is an annular member formed of two concentric ring elements of different diameters and joined in step formation along a common central portion. This provides an outer surface being received by the upper edge portion of the top ring and an inner surface which receives and retains the manhole cover.

In modified embodiments the ring assembly includes an annular cylindrical, ring which forms a lower lock ring received in the interior or inner periphery of the top ring and an extender ring secured to the top of the lock ring. The effective inside diameter of this extender ring can be larger or smaller than the previously used manhole cover so as to standardize the size manhole cover used. The extender ring and the lock ring can each be cast as a unitary annular ring or extended and then cut to size or can be molded in several segments which are joined or seated during usage by caulking or the like. The product is extremely tough and wear-resistant.

One object of this invention is, therefore, to provide a better and more economical means for extending manholes in order to elevate the manhole cover to a new level when street paving takes place. The product of the invention is constructed of inexpensive material and lends itself to more economical manufacturing processes. It also provides a better seat for the manhole cover and is comparatively silent when vehicles pass over the manhole cover. Another advantage is that the new asphalt will lock the extender ring in place. Still another advantage of the present invention is that through use of a composite extender ring, the top ring can be made to receive larger or smaller manhole covers so as to standardize the size manhole cover used. The extender ring and the lock ring which at times cooperate with the extender ring, can each be molded as a unitary annular ring or extruded and then cut to size or can be molded in several segments which are joined or seated during usage by caulking or the like. The product is extremely tough and wear-resistant.

Other objects features and advantages of the invention will become apparent during the course of the following description.

DESCRIPTION OF THE PREFERRED EMBODIMENTS

Figure 2:
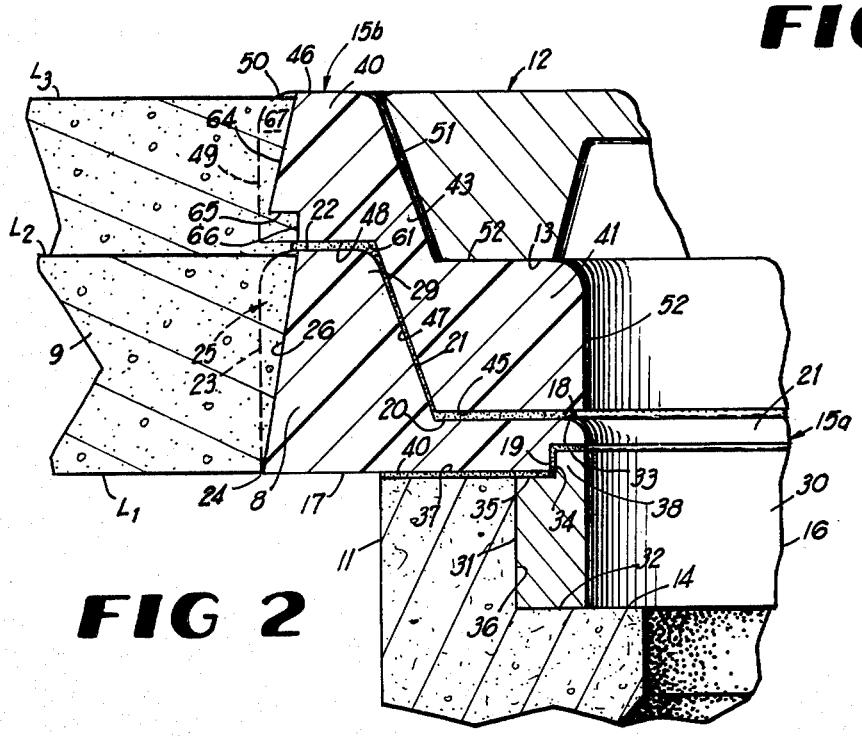
FIG. 2 is an enlarged fragmentary vertical sectional view of the manhole extension assembly depicted in FIG. 1, receiving a manhole cover after installation of the assembly on the manhole top ring and after resurfacing of the road.

Referring now in detail to the embodiments chosen for the purpose of illustrating the present invention, numeral 10 designates a manhole sub-structure having the usual top ring 11 formed of cast iron for the support of a cast iron manhole cover 12 shown in FIG. 2. The cover 12 has an annular peripheral flange 13 which, if of a smaller size, would rest upon a depressed annular radially extending shoulder or seat 14 formed on the top ring 11.

With the passage of time, the street or roadway in which the manhole 10 is located and which has a roadway level L1, will require repavement and this operation produces a new and elevated pavement level which may be level L2 and/or subsequently level L3 depending upon how much asphalt or other paving material 9 is employed. Consequently, the manhole cover 12 must be raised to be nearly flush with the new pavement level L3. In the present invention is embodied an improved manhole extension assembly in the form of plastic rings 15*a* and a lower ring element including ring 15*b* which serve the double function of supporting the manhole cover 12 at an elevated level L2 if ring 15*a* is used and level L3 if both rings 15 and 15*b* are used. Each ring 15*a* and 15*b* will increase the effective size of the seat so as to receive a standard and larger manhole cover 12.

In more detail, the bottom or lower ring element has a plastic transition extender ring 15*a* and a lock ring 16 each being a molded unitary continuous ring. Ring 15*a* comprises an annular section 8 and a lower inwardly protruding flange 7 defining a radially disposed bottom surface 17 disposed in a common radial plane. The lower inner peripheral portion of the flange 7 of ring 15*a* is notched to provide annular recess defined by an inner radially extending shoulder 18 which is offset upwardly from and disposed parallel to the bottom surface 17 and a vertical cylindrical shoulder 19 connected by its inner edge to the outer edge of the shoulder 18. Above the shoulder 18 and ring 15*a* is provided with a flat radially disposed seat 20 which forms the upper inner surface of the ring 15*a*. A rounded inner edge 21 joins the inner edge of the shoulder 18 to the inner edge of the seat 20.

The upstanding outer section 8 is defined by an inclined frusto-conical upwardly diverging inner peripheral wall 21, the upper edge of which merges with the upper radial surface 22 of the ring 15*a*. The upper surface 22 is parallel to the bottom surface 17 and is disposed above the outer portion of the bottom surface 17. The outer periphery of surface 22 merges with the cylindrical outer wall 23 of the ring 15*a*. This outer cylindrical wall 23 has a lower edge which joins the outer periphery of the bottom surface 17 along an annular lower corner edge 24.

According to the present invention, a plurality of circumferentially equally spaced outwardly opening notches 25 are provided in the outer wall 23 of section 8. Each notch 25 extends from surface 17 to surface 22 and is defined by an upwardly inclined flat inner surface 26 and a pair of opposed parallel side walls 27. The inner walls 26 thus taper upwardly from the common edge 24 and terminates inwardly of the outer extremity of the upper surface 22. The recesses 25 are, therefore, essentially triangular, the right angular corner being rounded. The function of the notches 25 is to receive the asphalt or other paving material 9 which is compacted down around the ring 15*a* so as to provide locking keyways which not only will prevent appreciable rotation of the ring 15*a* but also will prevent the floating of the ring 15*a* upwardly by the paving material.

As pointed out above, the lower ring element includes an annular lock ring 16 received within the throat of the top ring 11. The lock ring 16 is an annulus defined by a cylindrical inner peripheral wall or surface 30*a* concentric cylindrical outer peripheral wall or surface 31, a flat radially disposed bottom surface 32 and a flat radially disposed upper surface 33. Thus, the lock ring 16 has an upper annular flange on its upper end.

The upper radial surface 33 of the flange is of slightly less thickness or lateral width as the shoulder 18. The outer edge of the upper surface 33 terminates at the upper edge of a cylindrical outer shoulder 34, the lower edge of which terminates at the inner edge of an upper outer radial surface 35. The upper outer surface 35 is parallel to and spaced downwardly from the inner surface 33. Thus, the flange of the ring 16 will receive the inner portion of the ring 15*a* with the surfaces 18 and 33 in abutting relationship and the surface 19 and 34 in abutting relationship. Furthermore, a small portion of the upper outer surface 35 will be in abutting relationship with the inner portion of the surface 17.

The height and diameter of the outer peripheral surface 31 of the ring 16 is approximately equal to the length and diameter of the inner periphery 36 of the top ring 11. Hence, the ring 16 will be received by the shoulder 14 with the outer periphery of the ring 16 abutting the inner periphery 36. The inner wall 33 which is longer, thus protrudes above the upper level or upper surface 37 of the ground ring 11. It will also be observed in FIG. 2 that the bottom surface 37 of the ground ring 11. Hence, the ring 15*a* protrudes outwardly of the ground ring 11. Adhesive or caulking material or mastic 40 which is disposed between the abutting surfaces 17 and 37 as well as the abutting surfaces 17 and 35; 19 and 34; and 18 and 33; secure the lower ring 15*a* onto the upper surface of the ring 16 and both rings 15*a* and 16 to the top ring 11.

The function of the lower ring 15*a* is to serve as an adapter for either receiving a larger diameter manhole cover 12 where a resurfacing to level L2 is involved or receiving the bottom surface area of the upper ring 15*b* if a resurfacing to level L3 is involved. Thus, in a first repaving of a street containing the manhole 10, the level of the street may be raised from level L1 to level L2 in which case only the ring 15*a* will be employed and received in the manhole cover 12. A subsequent paving, however, can raise the level of the street to level L3 and under these circumstances, the additional ring 15*b* will be employed as will be explained, hereinafter.

Figure 1:
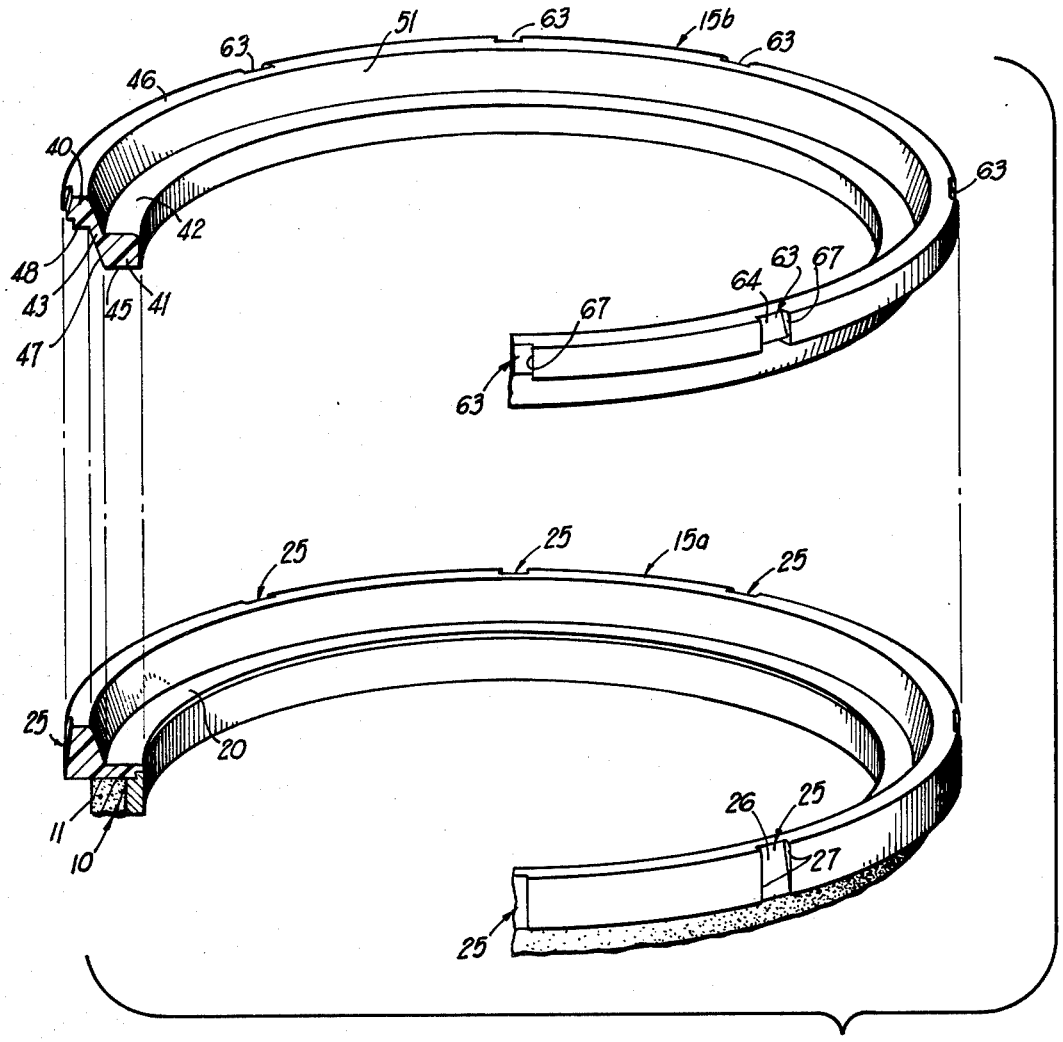
FIG. 1 is an exploded fragmentary prospective view of a manhole extension assembly constructed in accordance with the present invention and seated on the top ring of an existing manhole, the assembly being a double ring assembly for supporting the manhole cover at a relatively short distance above the original level of the paving and also enlarging the seat for receiving a larger standard size manhole cover.

The plastic extender ring 15*b*, as shown in FIGS. 1 and 2 is also a molded unitary continuous ring, being formed of two annular concentric different diameter ring segments or portions of stepped formation to provide an upper large marginal ring portion 40 disposed outwardly of and surrounding the flange 13 of cover 12 during use, and disposed immediately above the upper extremity of the lower ring 15*a*. The stepped extender ring 15*b* also has a lower smaller annular ring section 41 disposed below the cover flange 13 and forming a level radial seat 42 therefor. The lower ring section 41 lies inwardly of and is disposed in concentric relationship to the marginal ring portion 40, the two elements 40 and 41 being connected together by an inclined conical intermediate portion 43.

In more detail, the extender ring 15b along the bottom portion of the lower annular ring section 41 has a flat radially disposed or bottom surface 45. Along the upper portion of the upper annular ring section 40, ring 15b has a flat radially disposed upper surface 46 which is parallel to surface 45. The lower section 41 has a lower outer frusto-conical peripheral wall 47 which tapers downwardly and inwardly from the flat radial outwardly protruding outer shoulder or flange 48, the outer shoulder 48 forming the bottom of the upper section 40, and being parallel to surfaces 45 and 46. The lower edge portion of wall 47 thus joins the bottom surface 45 at an obtuse angle equal to the obtuse angle at which it joins the outer shoulder 48.

The upper outer peripheral wall 49 of the upper section 40 is cylindrical and extends from shoulder 48 upwardly to merge into an arcuate convex annular corner surface 50 which curves inwardly and, in turn, merges with the outer periphery of the upper surface 46. The diameter of wall 49 is preferably equal to the diameter of outer cylindrical wall 23 of ring 15a.

At the inner periphery of the inner surface 46, the inner upper wall 51 projects downwardly and inwardly, being frusto-conical and tapering downwardly to terminate at the outer periphery of the radial seat 52. At the inner periphery of seat 52, the inner lower cylindrical wall 53 extends downwardly to terminate at the inner periphery of the bottom surface 45.

In the present embodiment, the seat 52 is disposed below the shoulder 48, in parallel relationship thereto. Also, the inclination of the upper wall 51 and the outer wall 47 are substantially equal, the wall 51 being spaced above and concentric with the wall 47. The length of the wall 47 and the length of wall 21 are approximately equal. Also, the width or length of the wall 22 and the wall 48 are approximately equal. Furthermore, the width of shoulder 20 and bottom surface 47 are approximately equal. Hence, the ring 15b with nest in and be received by the ring 15a. The distance between the surfaces 46 and 48, i.e., the height of section 40 is approximately equal to the thickness of the resurfacing, that is the distance between the surface L2 and the surface L3. Furthermore, the diameter of the ring 15b is such that it will receive the manhole cover 12 with the flange 13 being received on the seat 52 and the body of the manhole cover 12 being confined within the inner wall 51 as illustrated in FIG. 2.

It will be observed that the diameter of the inside surfaces 52, 21 and 30 of the rings 15b, 15a and 16 respectively is larger than the inside diameter of the wall 60 of the to ring 11. Hence, an enlarged manhole cover 12 can be received on the ring 15a or on the ring 15b, as desired.

Mastic, caulking or other adhesive 61 is employed for joining the ring 15b to the ring 15a, as illustrated in FIG. 2. The mounting of the manhole cover 12 in place will urge the ring 15b into registry with the ring 15a and also urge the ring 15a into a seated condition on the upper surface of the top ring 11 and also into position on the ring 16. Thus, the mastic 37 and the mastic 61 will firmly seat the elements, as illustrated in FIG. 2.

In the embodiments of FIGS. 1 and 2, it will be seen that ring 15b is provided with a plurality of radially equally spaced notches 63 in the outer periphery or outer wall 49 of the upper ring section 40. These notches 63 provide outwardly opening recesses for the receipt of the paving material or asphalt 9. Each notch 63 is also defined by opposed parallel axially disposed side walls 67. When ring 15b is seated on ring 15a, the notches 25 and 63 should be vertically aligned so that the asphalt 9 will lock the two rings 15a and 15b rotationally together and prevent floating of ring 15b.

Figure 3:
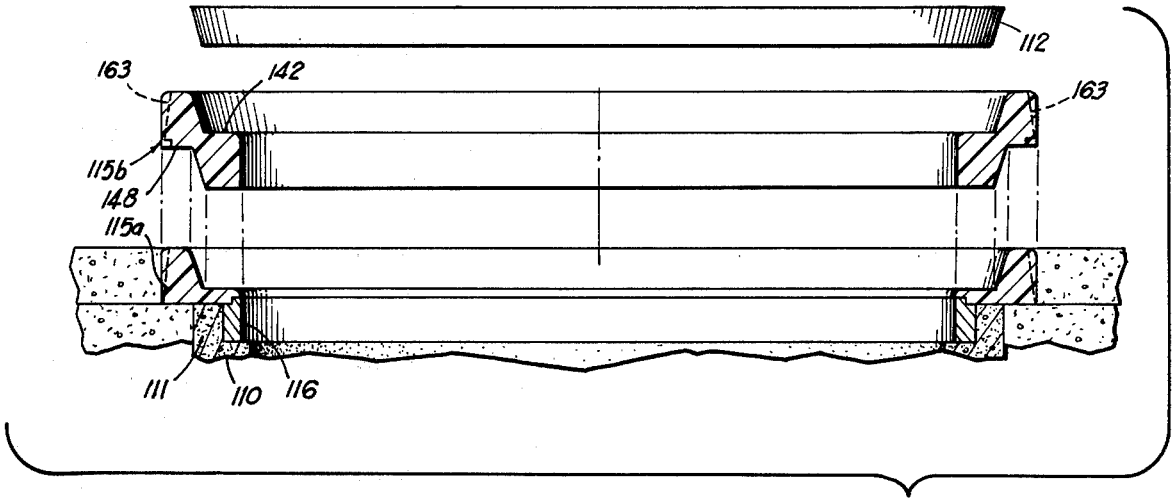
FIG. 3 is an exploded vertical sectional view of a modified form of the manhole extension assembly depicted in FIGS. 1 and 2, the view showing the installation of successive rings at different times in paving to raise the seat for supporting a manhole cover by an initial given distance and then a second distance.

If additional height is required, a ring 115b, seen in FIG. 3 can be mounted on the ring 115a which in turn is mounted on the ring 116. The ring 116 and the ring 115a are identical to the rings 16 and 15a. Hence, no additional description is necessary. Furthermore, the top ring 111 of the manhole 110 is identical to the top ring 11 of manhole 10. Thus, no more detail description is required of this element. The difference between the rings 15b and 115b is that the seat 142 of ring 115b is spaced above the shoulder 148. Thus, the manhole cover 112 will be raised a distance greater than the manhole cover would be raised by the addition of the ring 15b.

Figure 4:
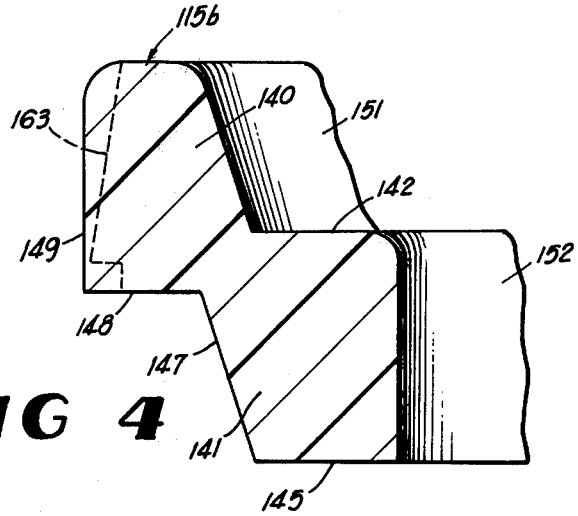
FIG. 4 is an enlarged fragmentary sectional view of one of the rings of the assembly of FIG. 3.

The embodiment depcited in FIGS. 3 and 4 include circumferentially spaced notches 163 which are identical to the notches 63. The asphalt, when laid down, will seep into these notches 63 and prevent rotation of the ring 115b as well as preventing upward movement to any appreciable extent of the ring 115b.

It is now seen that the ring 115b includes an upper section 140 and a lower section 141, the outer walls 149, 148 147 and 145 of which are identical to the corresponding portions of the rings 15b. The inner cylindrical wall 152 is simply longer than the cylindrical wall 52 while the seat 142 and the inside wall 151 are identical in dimensions to the corresponding seat 52 and wall 51 of the preceeding embodiment.

Figure 5:
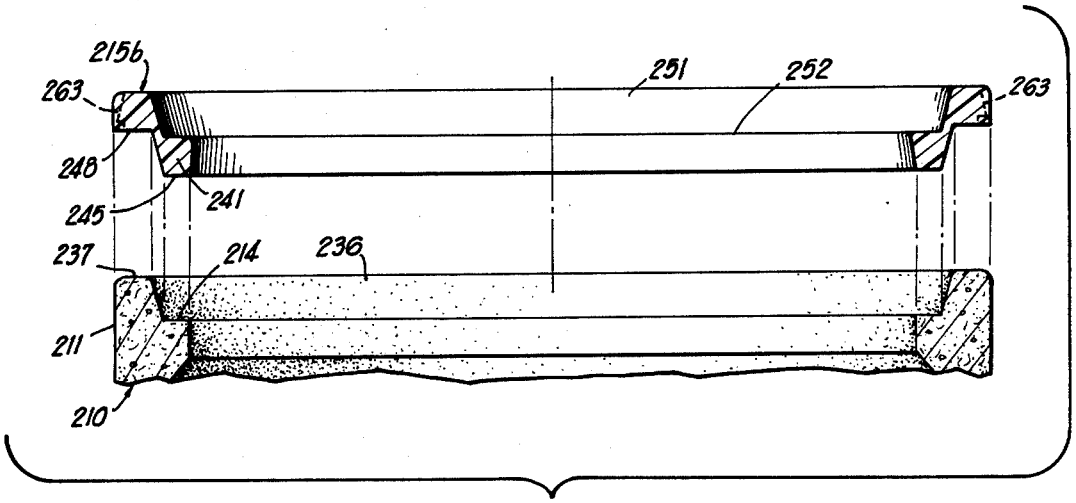
FIG. 5 is an exploded fragmentary vertical sectional view of another modified form of the present invention and showing a single ring manhole extension assembly for raising the level of the manhole cover by a relatively short distance while maintaining the diameter of the seat the same as the previous seat.

In the embodiment depicted in FIG. 5, a ring 215b which is identical to ring 15b is illustrated as being seated directly upon the top ring 211 of a manhole 210. In this arrangement, the shoulder 248 seats directly upon the upper horizontal surface 237 of the top ring 211 so that the lower section 241 of the ring 215b is received within the inclined annular surface 236 of the top ring 211. In such an arrangement, the lower wall 245 seats on the upper shoulder 214 of the top ring. Mastic or other adhesive, not shown, secures this ring 215 in place. Thus, when the ring 215b is seated, additional new paving or asphalt may be added to provide a height of the upper surface of ring 215b so that the asphalt flows into the notches 263 in the ring 215. Of course, the manhole cover (not shown) in FIG. 5 is received in the inner frusto-conical surface 251 of ring 215b and the outer flange of such manhole cover rests upon the seat 252 of ring 215b.

When the ring 215b is in place, and when the asphalt or paving material is installed, the inclination of the surfaces 264 which taper upwardly, enables the asphalt to exert a downward force on the ring 215 and prevent any appreciable upward movement thereof. Furthermore, as pointed out above, the asphalt also prevents inadvertent rotation of the ring 215b. The purpose of the overhanging ledge as defined by the shoulder 265 is to enable the asphalt to flow into the circle defined by the outer surface 249 of ring 215b so as to essentially lock the ring 215b in place.

Figure 6:
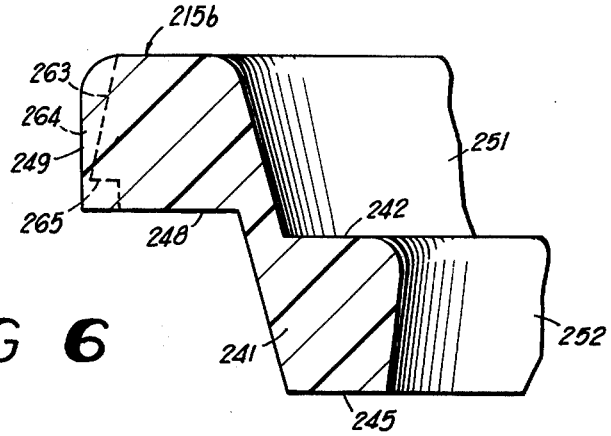
FIG. 6 is an enlarged fragmentary vertical sectional view of one of the rings of the assembly depicted in FIG. 5.
Figure 7:
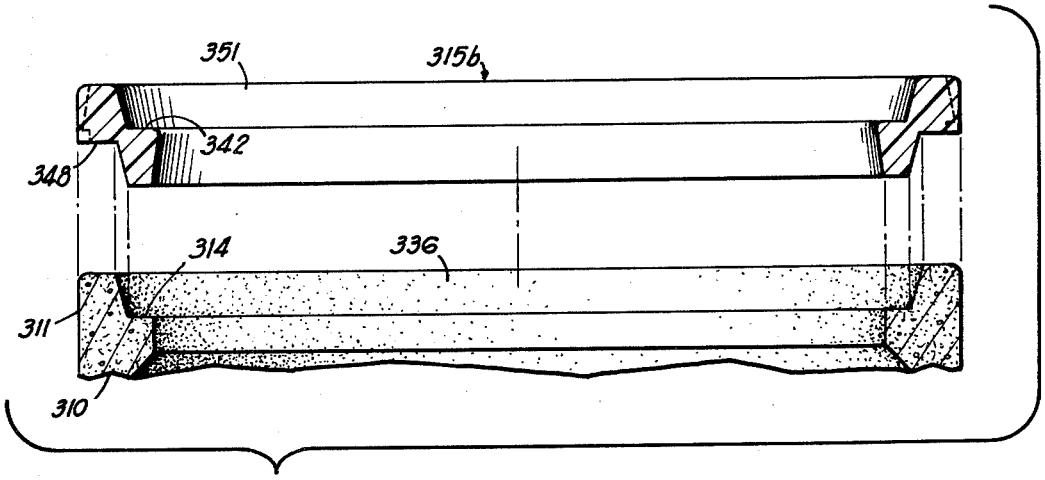
FIG. 7 is a view similar to view 5 but showing still another modified form of the present invention in which the height of raising the seat is greater than the distance by which the embodiment of FIG. 5.

In the embodiments of FIGS. 6 and 7, the ring is substantially identical to the rings 15b and 115b except that ring 315b has an inner lower inner annular surface 352 which tapers upwardly, being frusto-conical in contour. In this embodiment, the bottom surface 345 of the lower section 341 is received on the seat 314 of the top ring 311 of the manhole 310. The annular inner side wall 351 is thus of smaller diameter than the diameter of the inner side wall 336 of top ring 311. Hence, when the ring 315*b* is mounted on the top ring 311, it will adapt the manhole 310 to receive a smaller standard manhole cover (not shown).

Figure 8:
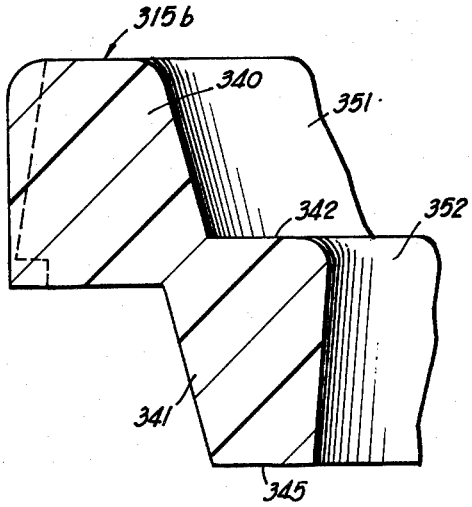
FIG. 8 is a view similar to FIG. 6 and showing the ring of FIG. 7.

The difference between the structure depicted in FIGS. 5 and 6 and the structure depicted in FIGS. 7 and 8 is that the seat 242 of the ring 215*b* is below the outer bottom surface 248 in the structure of FIGS. 5 and 6 while the seat 342 is FIGS. 7 and 8 is above the bottom surface 348. Hence, the ring 315*b* will space a manhole cover a greater distance above the original postion of the manhole cover than the ring depicted in FIGS. 5 and 6. In both instances, the upper taper of the surface 252 or 352, as the case may be, will enable the providing of a seat 242 or 342 to receive a smaller size manhole cover than would have been received by the top ring 211 or 311 as the case may be.

Figure 9:
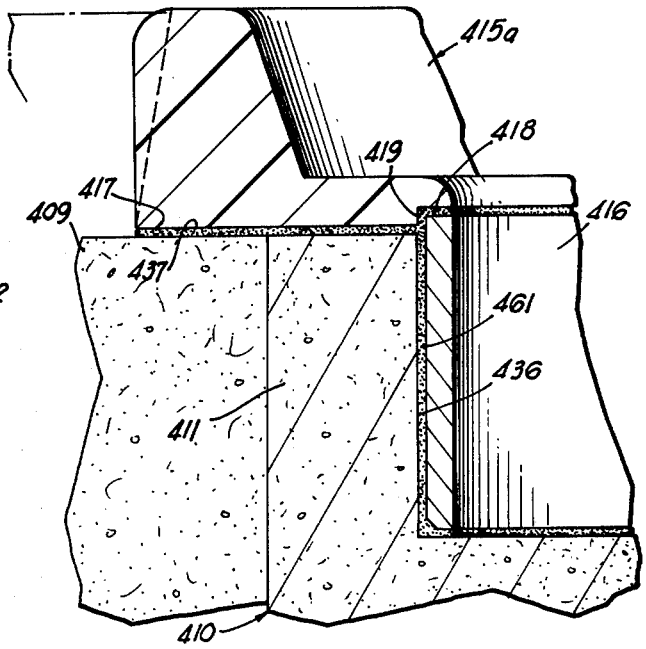
FIG. 9 is a vertical sectional view of one form of an extender ring and a lock ring assembly employed to raise the level of the manhole cover and increase the effective size of the seat for the manhole cover.

The embodiments depicted in FIGS. 9–12 respectively show composite ring elements or assemblies which adapt the top ring to receive larger size manhole covers while raising the effective surface of the top ring. Thus, in FIG. 9 a ring 415*a* which is identical to the ring 15*a* is illustrated as being mounted on a ground ring 411 of a manhole 410. In this embodiment, a thin annular lock ring 416 of rectangular cross-section is depicted as being received within the cylindrical inner wall 436 of the ground ring 411. Mastic 461 is provided between the outer surface of lock ring 416 and the inner surface 436 of the top ring 411. This same mastic 461 extends between the upper surface 437 of the top ring 411 and the bottom surface 417 of the ring 415*a*. The inner notch defined by the shoulder 418 and 419 of the ring 415*a* receive the upper edge portion of the annular ring 416 as illustrated in FIG. 9. Furthermore the mastic 461 may extend over the existing asphalt 409 and adhere the outer portion of the bottom 417 to this asphalt. The structure of FIG. 9 depicts an extension ring which is suitable for the standard MH frame of Owensboro, Kentucky. If an adapter is employed for an MH-RCR-2001 type of frame, a lock ring 516 shown in FIG. 10 can be employed. The transitional extension ring 515*a* is identical to the rings 15*a*, 115*a* and 415*a*.

Figure 10:
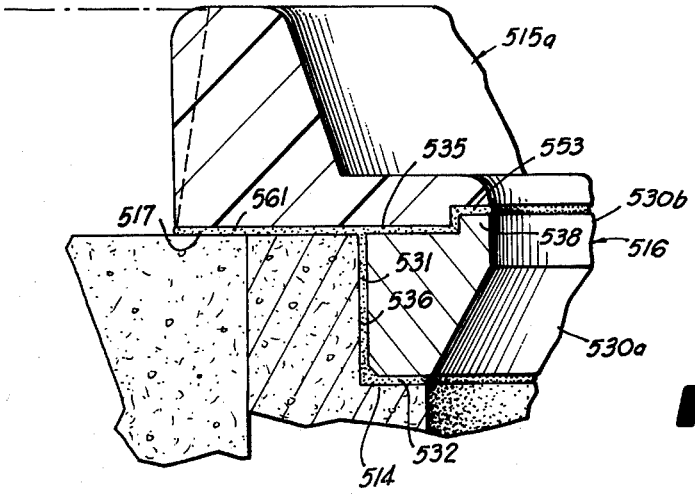
FIGS. 10, 11 and 12 are each views similar to FIG. 9 but showing still other modified forms of the present invention.
Figure 11:
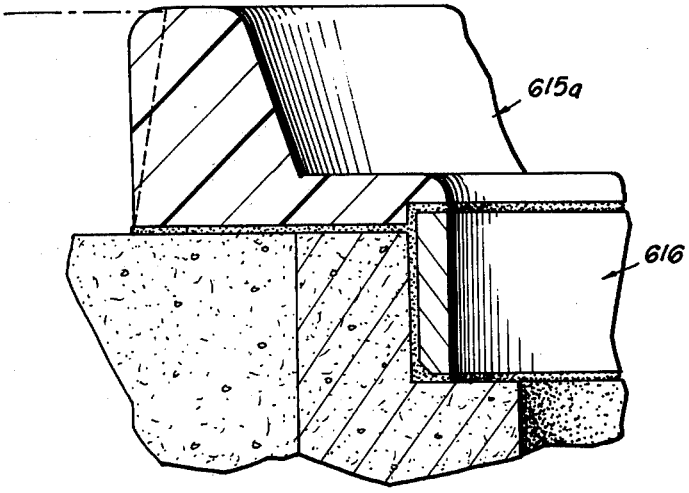
Figure 12:
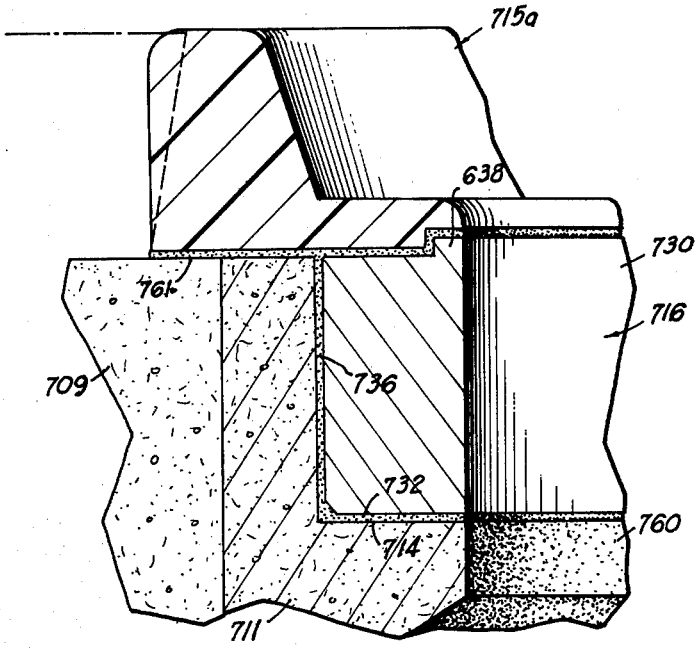

The lock ring 516 of FIG. 10 is an annular member having a cylindrical outer surface 531 a flat bottom surface 532, a frusto-conical upperwardly converging inner bottom wall 530*a* the upper edge of which merges with a cylindrical upper inner wall 530*b*. The ring 516 includes a much wider upper surface 535 and the offset upper surface 533. In this construction, mastic 561 throughout the bottom surface 517 of the ring 515*a* and between the wall 531 and wall 536 of the ground ring 511. The mastic also extends between the wall 532 and the shoulder 514 of the ground ring as well as between the upper wall 535 and the wall 517.

If a 24" standard MH frame is adapted according to the teachings of the present invention, the lock ring can be a torical structure generated by a rectangular cross section to produce the lock ring 616 which receives the transitional extension ring 615*a* which is identical to the preceding transitional extension rings 15*a*, 115*a*, 415*a* and 515*a*. Such a construction is suitable for Columbus. Ohio. If a transitional extension ring is require for Dekalb County, Georgia, which employs a standard MH frame, the structure in FIG. 12 would be suitable. In this structure, the lock ring 716 has an upstanding annular flange 638 which is similar to the upstanding annular flange 38 and 538. The inner periphery or wall 730 is of the same diameter as the inner peripheral wall 760 of the ground ring 711. The thickness of the lock ring 716 is substantially greater than the thickness of the lock ring 16. Otherwise the structure is identical to the lock ring 16 while the structure of the transitional extension ring 715*a* is identical to the preceding extension rings 15*a*, 115*a*, 415*a*, 515*a* and 615*a*. The mastic 761 adheres the bottom surface of the ring 715*a* to the existing pavement 709 and to the upper surface of the top ring 711 as well as to the upper surface of the lock ring 716. Furthermore, the mastic 761 secures the outer periphery of ring 716 to the inner peripheral wall 736 of the top ring 711. Furthermore, the bottom surface 732 is secured by mastic to the seat 714 of the top ring.

The extender rings 15*b*, 115*b*, 215*b*, 315*b*, and the transitional extension rings 15*a*, 315*a*, 415*a*, 515*a*, 615*a* and 715*a* and the lock rings 16, 416, 516, 616 and 716 are preferably formed of polypropylene or nylon. The polypropylene is extended by an inert filler such as fiberglass, talc, chalk, sand or expanded vermiculite. The resulting plastic composition will have a melting point in the vicinity of 500° F. and will not melt at 350° F. but will soften somewhat at this temperature. Asphalt paving material is usually applied to roads at about 300° F. The softening of the plastic extender ring at the asphalt application temperature will actually improve the seating of the heavy manhole cover 12 as the plastic ring will conform to its shape as well as the shape of the supporting shoulder 14.

The color of the various plastic rings is preferably black or dark red to prevent deterioration caused by ultraviolet radiation. Cold flow in the various rings is not more than about 10% and the plastic material is slightly pliable above about 250° F. All of these stated physical characteristics of the various rings contribute toward their improved performance over customary prior at, welded metal extender rings or much more costly adjustable screw threaded extender means.

One or two rings such as ring 15*b* can be used and hence the repaving of the roadway can be accomplished up to three times. Ordinarily three rings is the maximum number of rings which should be used to elevate the manhole cover.

While I have illustrated that the various rings are unitary and molded, if desired, the rings may be extruded as a helix and cut off to proper length to produce the ring. The seating of the manhole cover will bring the two ends into alignment. Furthermore, the rings may be trimmed for decreasing the diameter of the ring, if desired. Also, inserts may be provided to increase the diameter of the ring.

The major advantages of the manhole extender rings of the present invention are that a city may now standardize on a size or sizes of manhole covers and the cost of manufacturing and installing these rings is substantially less than the procedure presently employed. A better seating of the manhole cover and less noise when traffic passes over the manhole is experienced. When a size is standardized, the invention of a particular city may be reduced both as to the number of manhole covers and to the supplies necessary for raising the effective height of a manhole.

Of significance is that fact that the notches, such as notches 25 and 63, when they receive the soft asphalt, serve to urge the rings into their seated positions. Of course, the plastic rings are much lighter than the prior art metal members which are employed to raise the effective height of a manhole.

It will be obvious to those skilled in the art that many variations may be made in the embodiments here chosen for the purpose of illustrating the present invention and that full result may be had to the doctrine of equivalents without departing from the scope and spirit of this invention as defined by the appended claims.

I claim:

1. A manhole extension assembly comprising in combination with a manhole cover and a manhole having a top ring embedded in pavement of a plastic extender ring member having a bottom surface mounted in concentric relationship on the upper end portion of said top ring of said manhole below pavement level, said ring member having an upper surface which has an annular recessed seat therein for receiving and seating said manhole cover with its upper level at about the level of said pavement, said ring member having circumferentially spaced peripheral outwardly opening recesses which receive the pavement therein to prevent appreciable rotation of said ring member and for overlapping of a portion of said ring member below the upper surface of said ring member to prevent appreciable upward movement of said ring member.

2. The extension ring defined in claim 1 wherein said recesses are defined by upwardly converging surfaces in said ring member.

3. The manhole extension assembly defined in claim 1 wherein said recesses are defined by upwardly converging surfaces and radially extending surfaces which converge to a horizontally disposed corner.

4. The manhole extension assembly defined in claim 3 wherein said recesses are also defined by horizontal surfaces extending outwardly and forming corners with the lower edges of said converging surfaces.

5. The assembly defined in claim 1 wherein said ring member includes two concentric sections, one being of smaller diameter than the other and an intermediate section joining said two concentric sections thereby to define an inner seat above the smaller diameter concentric section and an outer bottom surface below the larger concentric section, said sections having inner peripheries corresponding in diameters to the diameters of the inner peripheries of said top ring and being bevelled along their inner peripheries for receiving therein said cover of said top ring.

6. The manhole extension assembly defined in claim 5 wherein said seat is above said bottom surface.

7. The extender ring defined in claim 5 wherein said seat is below said bottom surface.

8. The assembly defined in claim 1 including adhesive along the bottom surface area of said ring member for adhering said ring member to said top ring.

9. The manhole extension assembly defined in claim 1 wherein said ring member includes a flat bottom which is wider than the width of said top ring and extends inwardly of the inside surface of said top ring, and an annular lock ring disposed within said top ring and adhesively secured to the portion of said ring member which extends inwardly of said ground ring.

10. The manhole extension assembly defined in claim 9 wherein said lock ring is rectangular in cross section.

11. The manhole extension assembly defined in claim 9 wherein said lock ring includes an annular inner surface and a frustoconical surface below said inner surface.

12. The manhole extension assembly defined in claim 11 including a second extender ring nested within said ring member, said second extender ring having a seat above the seat of said ring member.

13. The manhole extension assembly defined in claim 1 wherein said top ring includes a seat which originally received said manhole cover and wherein said seat of said extender member is of a diameter larger than the diameter of said seat of said ground ring.

14. The manhole extension assembly defined in claim 1 wherein said top ring includes a seat which orginally received said manhole cover and wherein said seat of said extender member is of a diameter smaller than the diameter of said seat of said ground ring.

* * * * *